US006505562B1

(12) United States Patent
Wu

(10) Patent No.: US 6,505,562 B1
(45) **Date of Patent: *Jan. 14, 2003**

(54) GAS GENERATOR COMPOSITION AND MOLDING THEREOF

(75) Inventor: Jianzhou Wu, Himeji (JP)

(73) Assignee: Daicel Chemical Industries, Ltd., Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/171,955

(22) PCT Filed: Mar. 17, 1998

(86) PCT No.: PCT/JP98/01126

§ 371 (c)(1),
(2), (4) Date: Nov. 3, 1998

(87) PCT Pub. No.: WO98/42642

PCT Pub. Date: Oct. 1, 1998

(30) Foreign Application Priority Data

Mar. 24, 1997 (JP) ..... 9-69823

(51) Int. Cl.[7] ..... C06B 45/10

(52) U.S. Cl. ..... 102/531; 102/283; 149/19.91; 149/46

(58) Field of Search ..... 149/19.7, 19.91, 149/46; 102/531, 283

(56) References Cited

U.S. PATENT DOCUMENTS

| | | | | | |
|---|---|---|---|---|---|
| 2,942,964 | A | * | 6/1960 | Burgwald et al. | 149/19.7 |
| 3,986,908 | A | | 10/1976 | Grebert et al. | |
| 4,111,728 | A | | 9/1978 | Ramnarace | |
| 4,128,996 | A | | 12/1978 | Garner et al. | |
| 4,214,438 | A | * | 7/1980 | Hamilton et al. | 149/19.6 |
| 4,246,051 | A | * | 1/1981 | Garner et al. | 149/19.91 |
| 4,369,079 | A | | 1/1983 | Shaw | |
| 4,552,736 | A | * | 11/1985 | Mishra | 149/19.1 |
| 4,909,549 | A | | 3/1990 | Poole et al. | |
| 5,125,684 | A | * | 6/1992 | Cartwright | 149/19.7 |
| 5,458,706 | A | * | 10/1995 | Finck et al. | 149/19.2 |
| 5,486,248 | A | | 1/1996 | Taylor et al. | |
| 5,531,941 | A | * | 7/1996 | Poole | 149/47 |
| 5,545,272 | A | | 8/1996 | Poole et al. | |
| 5,551,725 | A | * | 9/1996 | Ludwig | 280/741 |
| 5,596,168 | A | * | 1/1997 | Menke et al. | 149/19.1 |
| 5,641,938 | A | * | 6/1997 | Holland et al. | 149/19.1 |
| 5,827,996 | A | * | 10/1998 | Yoshida et al. | 149/45 |
| 5,847,311 | A | * | 12/1998 | Ryder | 149/19.4 |
| 6,019,861 | A | * | 2/2000 | Canterberry et al. | 149/19.1 |

FOREIGN PATENT DOCUMENTS

| | | | |
|---|---|---|---|
| DE | 4116882 | A1 | 12/1992 |
| DE | 94161127 | | 2/1995 |
| EP | 0553476 | A1 | 8/1993 |
| EP | 0576326 | A1 | 12/1993 |
| EP | 0659712 | A1 | 6/1995 |
| EP | 0705809 | A1 | 4/1996 |
| EP | 0757026 | A1 | 2/1997 |
| EP | 0816307 | A1 | 1/1998 |
| GB | 1228930 | | 4/1971 |
| JP | 49132208 | | 12/1974 |
| JP | 692770 | A | 4/1994 |
| JP | 6239683 | A | 8/1994 |
| JP | 7232989 | A | 9/1995 |
| JP | 7309194 | A | 11/1995 |
| JP | 7330477 | A | 12/1995 |
| JP | 9183682 | A | 7/1997 |
| WO | WO 9532165 | A1 | 11/1995 |
| WO | WO 9627574 | A1 | 9/1996 |

* cited by examiner

*Primary Examiner*—Edward A. Miller
(74) *Attorney, Agent, or Firm*—Birch, Stewart, Kolasch & Birch, LLP

(57) ABSTRACT

A gas generating composition for air bags to be used as occupant crash protection systems in automobiles, which is less toxic or dangerous, can be easily handled, has a high combustion efficiency and a high gas generation efficiency, produces few residue during combustion, can be safely manufactured and exhibits a high molding strength in the molding step; and a molded article thereof. The invention provides a gas generating composition containing (a) a fuel comprising at least one polymer compound selected from polyacrylic polymer compounds, polyacetal, urea resins, melamine resins, ketone resins and cellulose-based polymer compounds; (b) an oxidizing agent selected from ammonium nitrate and phase-stabilized ammonium nitrate; and (c) at least one combustion accelerator selected from oxyacid salts such as metal nitrates, metal nitrites, perchlorates and chlorates; a molded article thereof; and an inflator for air bags with the use of the same.

6 Claims, No Drawings

GAS GENERATOR COMPOSITION AND MOLDING THEREOF

This application is the national phase under 35 U.S.C. §371 of prior PCT International Application No. PCT/JP98/01126 which has an International Filing date of Mar. 17, 1998 which designated the United States of America, the entire contents of which are hereby incorporated by references.

TECHNICAL FIELD

This invention relates to a gas generating composition adequately employed in air bag restraint systems in automobiles and a molded article thereof. More particularly, it relates to a gas generating composition containing fuels comprising a specific polymer compound and an ammonium nitrate-type oxidizing agent as the base together with other additives and a molded article thereof.

BACKGROUND ART

Compositions containing sodium azide have been frequently employed as gas generating compositions for air bags to be used in occupant crash protection systems in automobiles. However, there arises in recent years a problem that sodium azide is toxic to the human body and dangerous in handling. Accordingly, attempts have been made to develop gas generating compositions containing various nitrogen-containing organic compounds as so-called non-azide gas generating compositions with improved safety.

For example, U.S. Pat. No. 4,909,549 has disclosed compositions of hydrogen-containing tetrazole and triazole compounds with oxygen-containing oxidizing agents; U.S. Pat. No. 4,369,079 has disclosed compositions of hydrogen-free bitetrazole metal salts with oxygen-containing oxidizing agents; and JP-A 6-239683 has disclosed compositions of carbohydrazide with oxygen-containing oxidizing agents.

Most of these non-azide gas generating compositions consist of fuels comprising nitrogen-containing organic compounds such as metal salts of tetrazole and bitetrazole, triazole or carbohydrazide with oxidizing agents such as potassium nitrate, strontium nitrate or potassium perchlorate.

Moreover, U.S. Pat. No. 5,545,272 has disclosed gas generating compositions comprising ammonium nitrate phase-stabilized with 7 to 20% by weight of a potassium salt and nitroguanidine, while WO 96/27574 has disclosed gas generating compositions comprising nitroguanidine, phase-stabilized ammonium nitrate and a rubbery binder.

Furthermore, JP-A 7-330477 has disclosed gas generating compositions comprising acrylate-terminated polybutadiene, polybutadiene polycarboxylic acid or epoxy-modified polybutadiene with a hardening agent and an oxidizing agent. JP-A 6-92770 has disclosed gas generating compositions particularly containing an organic binder forming azide groups, an active plasticizer and an oxidizing filler and characterized in that the binder is a product obtained by the reaction between a hydroxylated polyglycidyl azide and at least one polyisocyanate and that ammonium nitrate amounts to at least 85% by weight of the oxidizing filler.

However, these gas generating agents of the azide-type or the non-azide type free from ammonium nitrate are both poor in gas-generation efficiency. For example, the azide-type gas generating agents can generate at most 1.5 mol of gas per 100 g thereof, while the non-azide type ones free from ammonium nitrate can generate at most 2.5 mol of gas per 100 g thereof. In addition, a large amount of residues, which are liquid or solid at high temperatures, are formed during the combustion of these gas generating agents. If such residues are discharged as they are from the inflator, they would damage the air bag, which causes not only a burst of the air bag from the air bag system or combustion of the air bag but also fatal harm to the occupants' breathing.

To minimize the combustion residues discharged from inflators, it is therefore necessary to pack a large amount of filters into the inflators, which interferes downsizing and lightening of the inflators and elevates the production cost thereof.

Although the above-mentioned gas generating compositions comprising phase-stabilized ammonium nitrate and nitroguanidine as described in U.S. Pat. No. 5,542,272 and WO 96/27574 have higher gas-generation efficiencies and produce less residues, the phase-stabilized ammonium nitrate and nitroguanidine would form together a eutectic at 120° C. or below. As a result, it is feared that the gas generating agents may be molten at the welding step in the process of manufacturing inflators. In addition, these compositions containing the phase-stabilized ammonium nitrate and nitroguanidine have high explosive sensitivities, which brings about some problems in qualities and safety during the production of the gas generating agents.

Furthermore, there have been disclosed gas generating agents with the use of energy binders such as azide polymers and ammonium nitrate or phase-stabilized ammonium nitrate which produce few residues (for example, EP No. 705809). However, these gas generating agents would form harmful carbon monoxide in a large amount during combustion. Therefore, it is problematic to simply apply them to gas generating compositions for automotive air bags, though they might be adequate for rocket propellants.

DISCLOSURE OF INVENTION

An object of the present invention is to provide a gas generating composition which is less toxic or dangerous, can be easily handled, has a high combustion efficiency and a high gas-generation efficiency, produces few residues during combustion, can be safely manufactured, and exhibits a high molding strength in the molding step.

The present inventors have directed their attention to compositions of polymer compounds with ammonium nitrate which produce no or only a practically negligible amount of residues during combustion and have conducted intensive studies on the moldability, combustion properties, safety, practical availability, etc. thereof. As a result, they have found that gas generating compositions containing fuels comprising specific polymer compounds, ammonium nitrate-type oxidizing agents and oxyacid salts, optionally together with a combustion rate regulator such as carbon and a combustion-controlling catalyst such as metal oxides can be practically used solving the above problems. They have thus completed the present invention.

Accordingly, the present invention provides a gas generating composition characterized by containing the following components (a), (b) and (c):

(a) a fuel comprising at least one polymer compound selected from the group consisting of polyacrylic polymer compounds, polyacetal, urea resins, melamine resins, ketone resins and cellulose-based polymer compounds;

(b) an oxidizing agent selected from the group consisting of ammonium nitrate and phase-stabilized ammonium nitrate; and (c) at least one combustion accelerator selected from the group consisting of oxyacid salts.

The present invention further provides a gas generating composition which contains, in addition to the above components (a), (b) and (c), one or more members selected from the group consisting of the following components (d) and (e):

The group consisting of (d) a combustion rate regulator(s) selected from carbon and metallic powders; and (e) a combustion-controlling catalyst(s) selected from the group consisting of metal oxides.

The present invention furthermore provides a molded article of a gas generating composition in the form of a single-hole or porous column obtained by extrusion-molding the above gas generating composition, a molded article of the gas generating composition in the form of pellets obtained by compression-molding the above gas generating composition, and a molded article of the gas generating composition in the form of a film obtained by molding the above gas generating composition into a film.

The present invention furthermore provides an inflator for air bags with the use of the above gas generating composition or the above molded article of the gas generating composition.

The present invention provides a gas generating composition for air bags to be used as occupant crash protection systems in automobiles and a molded article thereof. The present invention has made it possible to produce a gas generating composition which is less toxic or dangerous, can be easily handled, has a high combustion efficiency and a high gas-generation efficiency and produces few residue during combustion, and a molded articles thereof.

PREFERRED EMBODIMENT OF THE INVENTION

The polymer compound of the component (a) to be used in the present invention serves as a fuel and a binder in the gas generating composition. When the oxygen balance, combustion properties, heat stability of the composition compounded with ammonium nitrate, etc. are taken into consideration, generally at least one polymer compound is used as the component of (a), which is selected from the group consisting of polyacrylic polymer compounds, polyacetal, urea resins, melamine resins, ketone resins and cellulose-based polymer compounds which are solid at the operating temperatures (−30 to 90° C.) of gas generating agents. Now, these polymer compounds will be detailed.

(1) Polyacrylic Polymer Compounds

Examples thereof include polyacrylamide, aminated polyacrylamide, polyacrylohydrazide, acrylamide/ammonium acrylate copolymer, acrylamide/metal acrylate copolymers and acrylamide/acrylic acid ester copolymers.

These polymer compounds are exemplified by those represented by the following general formulae (i) to (v):

$$(CH_2CHCONH_2)_n \quad \text{(i)}$$

$$(CH_2CHCONHNH_2)_n \quad \text{(ii)}$$

$$(CH_2CHCONH_2)_n—(CH_2CHCONHNH_2)_p \quad \text{(iii)}$$

$$(CH_2CHCONH_2)_n—(CH_2CHCOOM)_q \quad \text{(iv)}$$

$$(CH_2CHCONH_2)_n—(CH_2CHCOOR)_s; \quad \text{(v)}$$

wherein M represents ammonium or a metal ion such as a sodium or potassium ion; R represents a substituent such as $—C_2H_4N(CH_3)_2$; and n, p, q and s represent each the degree of polymerization and it is preferable that n ranges from 20,000 to 400,000, p ranges from 5,000 to 100,000, q ranges from 5,000 to 100,000 and s ranges from 5,000 to 50,000.

These polyacrylic polymer compounds are lowly toxic. For example, polyacrylamide shows an acute toxicity $LD_{50}$ (oral, mice) of 1,200 mg/kg or above and no mutagenicity, while polyacrylohydrazide shows an acute toxicity $LD_{50}$ (oral, mice) of 3,800 mg/kg or above and no mutagenicity. In contrast thereto, the conventionally employed sodium azide shows an acute toxicity $LD_{50}$ of 27 mg/kg. Thus, these polyacrylic polymer compounds are apparently much superior in safety in use to sodium azide.

(2) Polyacetal, Urea Resins, Melamine Resins and Ketone Resins

Polyacetal (also called polyformaldehyde) is excellent in heat resistance and chemical resistance and has good combustion properties due to its large oxygen content (53.3% by weight). Because of having a melting point close to that of ammonium nitrate, moreover, polyacetal can be molded in a molten state together with ammonium nitrate and other additives. Similar to polyacetal, urea resins, melamine resins and ketone resins are excellent in combustion properties, heat resistance and chemical resistance.

(3) Cellulose-based Polymer Compounds

Examples thereof include cellulose acetate, carboxymethylcellulose, ammonium carboxymethylcellulose, sodium carboxymethylcellulose and potassium carboxymethylcellulose.

Among the materials cited above as the component (a), it is preferable to use at least one member selected from the group consisting of polyacrylamide, aminated polyacrylamide, polyacrylohydrazide, acrylamide/ammonium acrylate copolymer, acrylamide/metal acrylate copolymers and acrylamide/acrylic acid ester copolymers, polyacetal, urea resins, melamine resins, ketone resins, cellulose acetate, carboxymethylcellulose, ammonium carboxymethylcellulose, sodium carboxymethylcellulose and potassium carboxymethylcellulose.

The content of the component (a) in the gas generating composition of the present invention preferably ranges from 3 to 40% by weight, still preferably from 5 to 30% by weight.

The oxidizing agent to be used as the component (b) in the gas generating composition of the present invention is ammonium nitrate or phase-stabilized ammonium nitrate. Ammonium nitrate, which has been widely used in fertilizers, explosives, etc., is composed of nitrogen, oxygen and hydrogen and thus forms no solid residue during combustion. In the present invention, use may be made of ammonium nitrate as such as the oxidizing agent. However, it is preferable to use so-called phase-stabilized ammonium nitrate containing a small amount of a potassium salt or other additives, since ammonium nitrate has several phase transition points within the operating temperature range.

The content of the component (b) in the gas generating composition of the present invention preferably ranges from 30 to 94% by weight, still preferably from 50 to 85% by weight.

In general, a binary composition consisting of the polymer compound of the above component (a) and the oxidizing agent of the above component (b) shows a low combustion rate and poor combustion properties. However, the combustion rate can be considerably elevated by adding a combustion accelerator which is at least one member selected from the group consisting of oxyacid salts, in particular, metal nitrates, metal nitrites, metal perchlorates and metal chlorates as the component (c).

As the combustion accelerator to be used as the component (c), it is preferable to select at least one member from the group consisting of potassium nitrate, sodium nitrate, strontium nitrate, potassium nitrite, sodium nitrite, ammonium perchlorate, sodium perchlorate, potassium perchlorate, sodium chlorate and potassium chlorate. It is particularly preferable to use therefor potassium nitrate, potassium perchlorate, potassium nitrite or potassium chlorate, since such a compound not only elevates the combustion rate of the binary composition comprising the above components (a) and (b) but also forms phase-stabilized ammonium nitrate together with the ammonium nitrate employed as the component (b) to thereby prevent the gas generating composition from changing in its volume within the operating temperature range.

Although the combustion rate of the gas generating composition can be further elevated by increasing the content of the component (c), the amount of the combustion residues is also increased thereby. Accordingly, it is preferable that the content of the component (c) in the gas generating composition of the present invention ranges from 0.5 to 20% by weight, still preferably from 3 to 15% by weight.

In addition to the components (a), (b) and (c) as described above, according to necessity, the gas generating composition of the present invention may further contain a combustion rate regulator selected from the group consisting of carbon and metallic powders as the component (d) to control the combustion rate. As the metallic powder to be employed as the combustion rate regulator of the component (d), use may be made of, for example, at least one member selected from the group consisting of aluminum powder, boron powder, iron powder and magnesium powder.

It is preferable that the content of the component (d) in the gas generating composition of the present invention is 5% or less by weight.

To further elevate the combustion rate, the gas generating composition of the present invention may also contain a combustion-controlling catalyst selected from the group consisting of metal oxides as the component (e). As the metal oxide powder to be employed as the combustion-controlling catalyst of the component (e), use may be made of, for example, at least one member selected from the group consisting of copper oxide, iron oxide, zinc oxide, cobalt oxide and manganese oxide. It is preferable that the content of the component (e) in the gas generating composition of the present invention is 5% or less by weight.

A particularly preferable example of the gas generating composition of the present invention is one which contains 6 to 16% by weight of polyacrylamide as the component (a), 70 to 85%, by weight of ammonium nitrate as the component (b) and 3 to 12% by weight of potassium perchlorate as the component (c).

Compared with the azide-type gas generating agents, the gas generating composition of the present invention has a largely elevated gas generation efficiency per unit weight, forms little combustion residues and ensures downsizing of inflators. A molded article is obtained with the use of the gas generating composition of the present invention by adding to the gas generating composition water or an organic solvent selected depending on the type of the component (a), homogeneously mixing the resultant mixture and extrusion-molding it to give a molded article in the form of a cylinder having a single hole or a cylinder having a plurality of holes. Alternatively, the mixture may be compression-molded by using a tabletting machine, etc. to give a molded article in a shape like a pellet. Alternatively, it may be molded into a film to give a filmy molded article. By processing into such a molded article, the gas generating composition of the present invention can be packed into an inflator.

The gas generating composition of the present invention and molded article thereof are applicable to air bag inflators at the driver's seat, air bag inflators at the seat next to the driver and side inflators. They are also applicable to hybrid inflators. Thus, it is unnecessary to provide an air bag inflator at the driver's seat with any filter for filtering residues, since the gas generating composition of the present invention and its molded article have a high gas-generation efficiency and produce few residue. Therefore, it will suffice when the inflator is merely packed with such a small amount of a coolant as to prevent the combustion flame from escaping out. By using the gas generating composition and its molded article according to the present invention, therefore, the volume, outer diameter and height of the combustion chamber can be reduced respectively to 40 $cm^3$ or less, 60 mm or less and 40 mm or less. In the case of a hybrid inflator, an oxygen-free compressed gas may be employed, since the gas generating composition and its molded article of the present invention has no or almost no oxygen balance.

EMBODIMENTS

To further illustrate the present invention in greater detail, the following Examples will be given. However, the present invention is not limited to these embodiments.

In the following Tables 1 to 5, PAA stands for polyacrylamide, PHA stands for aminated polyacrylamide, PAANa stands for an acrylamide/sodium acrylate copolymer, CMCNa stands for sodium carboxymethylcellulose, $CMCNH_4$ stands for ammonium carboxymethylcellulose, AN stands for ammonium nitrate, $KClO_4$ stands for potassium perchlorate, $KNO_3$ stands for potassium nitrate, C stands for carbon, CuO stands for copper oxide, NQ stands for nitroguanidine and PSAN stands for phase-stabilized ammonium nitrate ($AN/KClO_4$= 90/10).

EXAMPLES 1 TO 9 and

Comparative Examples 1 and 2

Gas generating compositions as listed in Table 1 were prepared. Table 1 also shows the theoretically calculated combustion temperature, gas-generation efficiency [the amount (mol) of gas generated from 100 g of the composition] and the amount of the residues produced [the amount (g) of solid residues produced with the generation of 1 mol of gas at ordinary temperature] of each composition.

TABLE 1

| | Gas generating composition | Wt. ratio | Combustion temp. (K) | Gas-generation efficiency | Residue produced |
|---|---|---|---|---|---|
| Ex. 1 | $PAA/AN/KClO_4$ | 12/83/5 | 2308 | 4.04 | 0.68 |
| Ex. 2 | $PAH/AN/KClO_4$ | 12/81/7 | 2300 | 4.02 | 0.93 |
| Ex. 3 | cellulose acetate/AN/$KClO_4$ | 14/81/5 | 2333 | 4.01 | 0.68 |
| Ex. 4 | polyacetal/AN/$KClO_4$ | 30/63/7 | 2337 | 4.00 | 0.93 |
| Ex. 5 | $PAA/AN/KNO_3$ | 11/82/7 | 2240 | 4.02 | 1.24 |
| Ex. 6 | $PAA/AN/KClO_4$/C | 7/83/7/3 | 2354 | 3.96 | 0.98 |

TABLE 1-continued

| | Gas generating composition | Wt. ratio | Combustion temp. (K) | Gas-generation efficiency | Residue produced |
|---|---|---|---|---|---|
| Ex. 7 | CMCNa/AN/$KClO_4$ | 15/82/3 | 2281 | 4.09 | 0.45 |
| Ex. 8 | PAANa/AN/$KClO_4$ | 11.7/81.3/7 | 2333 | 4.04 | 0.94 |
| Ex. 9 | PAA/AN/$KClO_4$/CuO | 11/82/7/0.5 | 2306 | 4.01 | 1.06 |
| Comp. Ex. 1 | sodium azide/CuO | 69/31 | 1374 | 1.59 | 35.14 |
| Comp. Ex. 2 | 5-amino-tetrazole/$KNO_3$ | 41/59 | 2115 | 2.40 | 16.33 |

EXAMPLES 10 TO 17

Gas generating compositions as listed in Table 2 were prepared and the friction sensitivity and drop hammer sensitivity of each composition were measured in accordance with the Testing Methods of Explosives as stipulated in Japanese Industrial Standards (JIS: K4810-1979). Table 2 summarizes the results.

TABLE 2

| | Gas generating composition | Wt. ratio | Friction sensitivity (kgf) | Drop hammer sensitivity (cm) |
|---|---|---|---|---|
| Ex. 10 | PAA/AN/$KClO_4$ | 12/83/5 | >36.0 | 30–40 |
| Ex. 11 | cellulose acetate/AN/$KClO_4$ | 14/81/5 | >36.0 | 30–40 |
| Ex. 12 | PAA/AN/$KNO_3$ | 11/82/7 | >36.0 | 30–40 |
| Ex. 13 | PAANa/AN/$KClO_4$ | 12/5/83 | >36.0 | 70–80 |
| Ex. 14 | $CMCNH_4$/AN/$KClO_4$ | 15.9/79.1/5 | >36.0 | 30–40 |
| Ex. 15 | PAA/AN/$KClO_4$/C | 7/83/7/3 | >36.0 | 50–60 |
| Ex. 16 | PAA/AN/$KClO_4$/CuO | 12/83/5/0.5 | >36.0 | 40–50 |
| Ex. 17 | PAH/AN/$KClO_4$/CuO | 11/82/7/0.5 | >36.0 | >100 |

EXAMPLES 18 TO 22 and

Comparative Example 3

Gas generating compositions as listed in Table 3 were prepared and the melting point, heat buildup starting temperature and TG weight loss starting temperature of each composition were measured by using a differential thermal analyzer (Model TAS-200, mfd. by Rigaku K.K.). The measurement was effected at a temperature rise rate of 20° C./min in a nitrogen gas atmosphere with the use of 1 to 3 mg of samples. Table 3 summarizes the results.

TABLE 3

| | Gas generating composition | Wt. ratio | Melting temp. (° C.) | Heat buildup starting temp. (° C.) | TG wt. loss starting temp. (° C.) |
|---|---|---|---|---|---|
| Ex. 18 | PAH/AN/$KClO_4$ | 12/81/7 | 159 | 229 | 231 |
| Ex. 19 | PAA/AN/$KClO_4$ | 11.6/81.4/7 | 158 | 245 | 245 |
| Ex. 20 | PAANa/AN/$KClO_4$ | 11.6/81.4/7 | 160 | 230 | 246 |
| Ex. 21 | CMCNa/AN/$KClO_4$ | 18/79/3 | 161 | 248 | 200 |
| Ex. 22 | PAA/AN/$KClO_4$/C | 7/83/7/3 | 160 | 210 | 216 |
| Comp. Ex. 3 | NQ/PSAN | 40/60 | 118 | 227 | 239 |

EXAMPLES 23 TO 33

Gas generating compositions as listed in Table 4 were prepared and molded into strands. Then the combustion rate of each composition was measured under a pressure of 70 $kg/cm^2$ in a nitrogen atmosphere. Table 4 summarizes the results.

TABLE 4

| | Gas generating compositlon | Wt. ratio | Combustion rate (min/sec) |
|---|---|---|---|
| Ex. 23 | PAA/AN/$KClO_4$ | 12/81/7 | 7.3 |
| Ex. 24 | PAH/AN/$KClO_4$ | 12/81/7 | 6.0 |
| Ex. 25 | PAANa/AN/$KClO_4$ | 12/81/7 | 7.0 |
| Ex. 26 | PAA/AN/$KNO_3$ | 12/79/9 | 6.6 |
| Ex. 27 | PAANa/AN/$KNO_3$ | 12/79/9 | 6.4 |
| Ex. 28 | PAH/AN/$KNO_3$ | 12/79/9 | 6.4 |
| Ex. 29 | PAANa/AN/$KClO_4$ | 12/79/9 | 7.3 |
| Ex. 30 | CMCNa/AN/$KClO_4$ | 20/72/8 | 7.2 |
| Ex. 31 | $CMCNH_4$/AN/$KClO_4$ | 16/79/5 | 7.1 |
| Ex. 32 | PAANa/AN/$KClO_4$/CuO | 12/81/7/0.5 | 6.7 |
| Ex. 33 | PAA/AN/$KClO_4$/CuO | 12/81/7/0.5 | 7.1 |

EXAMPLES 34 TO 38 and

Comparative Example 4

Gas generating compositions as listed in Table 5 were prepared and subjected to an initiation sensitivity test to confirm the safety thereof during production. The initiation sensitivity test was effected by packing each composition in a polyvinyl chloride tube (outer diameter: 30 mm, inner diameter: 25 mm, length: 200 mm) and closing the tube at one end thereof with a rubber stopper. Then a No. 6 instantaneous electric detonator was inserted into the tube from the other end thereof. Next, the tube was buried in sand (at a depth of 200 mm) and then exploded. After the completion of the test, the initiation sensitivity of each composition was evaluated based on the size of the crater thus formed and the residues. Table 5 summarizes the results.

TABLE 5

| | Gas generating composition | Wt. ratio | Initiation sensitivity |
|---|---|---|---|
| Ex. 34 | CMCNa/AN/$KClO_4$ | 18/79/3 | no |
| Ex. 35 | PAA/AN/$KClO_4$ | 12/81/7 | no |
| Ex. 36 | PAANa/AN/$KClO_4$ | 12/81/7 | no |
| Ex. 37 | PAH/AN/$KClO_4$ | 12/81/7 | no |
| Ex. 38 | PAA/AN/$KClO_4$/CuO | 12/81/7/0.5 | no |
| Comp. Ex. 4 | NQ/AN | 61/39 | yes |

EXAMPLE 39

65 g of water was added to 120 g of powdery polyacrylamide, 810 g of powdery ammonium nitrate and 70 g of powdery potassium perohlorate. After homogeneous mixing, the resultant mixture was extrusion molded into an extruded powder of 2.5 mm in outer diameter, 0.8 mm in inner diameter and 2 mm in length. After drying at 80° C. for 72 hours, 25.4 g of the extruded powder was filled into an inflator and subjected to a combustion test in a 60 l tank. Thus the tank pressure reached 2.2 kgf/$cm^2$ 51 msec after the initiation of the combustion. After the completion of the combustion, the gas generating agent in the tank was analyzed to find out that none of the components exceeded the permissible level.

What is claimed is:

1. A gas generating composition comprising:

6 to 16% by weight of (a) a fuel comprising polyacrylamide;

70 to 85% by weight of (b) an oxidizing agent comprising ammonium nitrate;

3 to 12% by weight of (c) a combustion accelerator comprising potassium perchlorate;

at most 5% by weight of (d) combustion rate regulators selected from the group consisting of carbon and metallic powders; and at most 5% by weight of (e) combustion-controlling catalysts selected from the group consisting of metal oxides.

2. The gas generating composition according to claim 1, wherein said combustion-controlling catalyst component (e) is at least one member selected from the group consisting of copper oxide, iron oxide, zinc oxide, cobalt oxide, and manganese oxide.

3. A molded article of a gas generating composition in the form of a hollow tube having a single through-hole or a tube having a plurality of through-holes obtained by extrusion-molding a gas generating composition according to claim 1.

4. A molded article of a gas generating composition in the form of pellets obtained by compression-molding a gas generating composition according to claim 1 or 2.

5. A molded article of a gas generating composition in the form of a film obtained by molding a gas generating composition according to claim 1 into a film.

6. An inflator for air bags which includes a gas generating composition according to claim 1.

* * * * *